United States Patent [19]

Kohara

[11] 4,108,095

[45] Aug. 22, 1978

[54] ROTARY LOOP TAKER FOR SEWING MACHINE

[75] Inventor: Tadao Kohara, Osaka, Japan

[73] Assignee: Maruzen Sewing Machine Co., Ltd., Moriguchi, Japan

[21] Appl. No.: 746,410

[22] Filed: Dec. 1, 1976

[30] Foreign Application Priority Data

Dec. 20, 1975 [JP] Japan ..... 50-172346[U]
Dec. 26, 1975 [JP] Japan ..... 50-180359[U]

[51] Int. Cl.[2] ..... D05B 57/14
[52] U.S. Cl. ..... 112/184; 112/230
[58] Field of Search ..... 112/228, 231, 198, 181, 112/186, 229, 230, 185, 187, 184

[56] References Cited

U.S. PATENT DOCUMENTS

| | | | |
|---|---|---|---|
| 2,390,126 | 12/1945 | Schifter | 112/198 |
| 2,990,794 | 7/1961 | Ketterer | 112/228 |
| 3,049,086 | 8/1962 | Johnson | 112/228 X |
| 3,090,335 | 5/1963 | Bono | 112/231 |
| 3,217,678 | 11/1965 | Fresard | 112/228 X |
| 3,416,472 | 12/1968 | Johnson | 112/228 X |
| 3,540,390 | 11/1970 | Eguchi | 112/228 X |

*Primary Examiner*—Werner H. Schroeder
*Assistant Examiner*—Moshe I. Cohen
*Attorney, Agent, or Firm*—Arnstein, Gluck, Weitzenfeld & Minow

[57] ABSTRACT

A loop taker mechanism and bobbin carrier for a sewing machine in which the bobbin carrier is formed of three components and is journalled in a rotary hook casing. An oscillating escapement yoke has two spaced beaks which cooperate with abutment faces on the carrier to prevent the carrier from rotating. One of the beaks carries an over-hanging guide plate which is wider than the beak and serves to prevent a thread loop from moving behind the beak and fouling the operation of the machine.

2 Claims, 8 Drawing Figures

ROTARY LOOP TAKER FOR SEWING MACHINE

BACKGROUND OF THE INVENTION

This invention relates to a loop taker mechanism of the vertical axis rotary hook type for sewing machines in which the bobbin carrier is journalled in and restrained against rotation.

One of the objects of this invention is the provision of rotation restraining means for a bobbin carrier which will permit smooth casting of needle thread loops about the bobbin carrier by the rotary hook.

Another object of this invention is the provision of improved rotation restraining means which is adjustable.

A further object of this invention is the provision of a thread guide associated with one of the rotation restraining elements for preventing the needle thread from moving behind the restraining element and fouling operation of the machine.

Still another object of this invention is the provision of a bobbin carrier formed of metal and molded plastic components.

Other and further objects and advantages of this invention will become apparent from the following description.

SUMMARY OF THE INVENTION

The loop taker mechanism of the present invention includes a rotatable body or casing having a hook and receiving a bobbin carrier. The carrier includes two spaced abutment faces disposed on both sides of the path of the needle. An escapement yoke provided with two beaks is oscillated by a rotatable cam so that one of the beaks is always in contact with one of the abutment faces to restrain the bobbin carrier against rotation while alternately leaving a space between the pairs of beaks and abutments for the passage of the upper thread loop.

BRIEF DESCRIPTION OF THE DRAWINGS

FIG. 3 is a vertical cross-sectional view of the device shown in FIG. 2, looking in the direction opposite from that in which FIG. 2 is viewed.

BRIEF DESCRIPTION OF A PREFERRED EMBODIMENT

Figure 1:
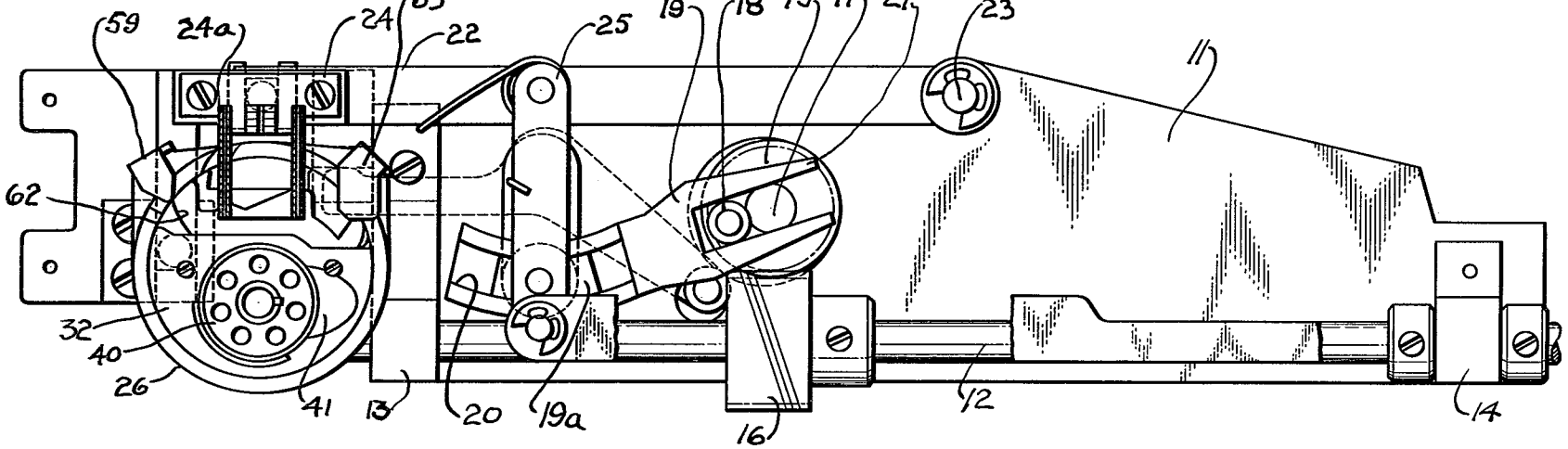
FIG. 1 is a top plan view of the mechanism in the base or lower arm of a sewing machine in which the present invention is embodied.
Figure 2:
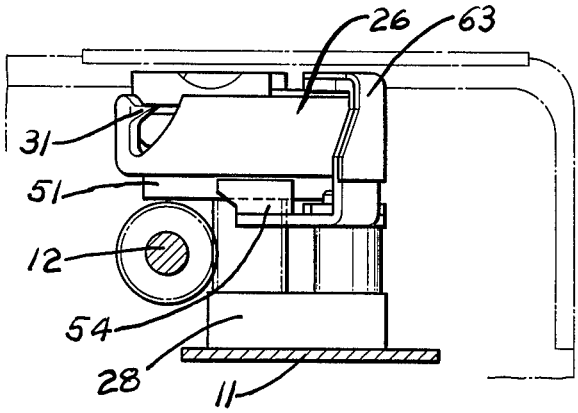
FIG. 2 is a fragmentary end elevational view, partly in cross-section, of the loop taker and bobbin carrier, in accordance with my invention.

The present invention, as illustrated in the drawings, is intended for use with a vertical axis rotary loop taker and is embodied in a sewing machine which includes in the work arm, a base member 11 having a rotary drive shaft 12 journalled in bearing members 13 and 14 supported on the base member. In the usual manner the shaft 12 is designed to actuate the loop taker and feed lift mechanism, hereinafter to be described, and is itself driven by any suitable means, not shown.

A rotary member 15 which includes a helical gear is rotatably supported on shaft 17 secured in base member 11. The helical gear cooperates with a worm wheel 16 fixed on drive shaft 12. The rotary member 15 carries on its upper surface a roller 18 disposed eccentric to the axis of shaft 17. A slide block guide 19 is supported on a vertical shaft, not shown, fixed in the base 11. The block guide 19 includes an integral fork portion 21 which embraces roller 18. Rotation of the rotary member 15 will effect rocking of the block guide 19 about the axis of its vertical shaft. A lever 22 is rockably supported on a shaft 23 fixed on the base plate 11 and a connecting bar 25 is connected, at one end, to an intermediate point of lever 22. The opposite end of the connecting bar 25 is connected to a slide block **19*a* slidably received in the guideway 20 of the block guide 19**.

A feed dog **24*a* is mounted on a feed dog support 24 which is actuated in a horizontal direction by lever 22. It will be understood that rotation of the rotary member 15 will effect rocking of the block guide 19 and transmit such motion to lever 22 to effect reciprocatory horizontal movement of the feed dog 24*a***.

The foregoing construction and its operation is more fully disclosed in co-pending application Ser. No. 744,135, now U.S. Pat. No. 4,074,644 and forms no part of the present invention.

The loop taker and bobbin carrier constituting the present invention is illustrated more clearly in FIGS. 2 through 8 and includes a cup-shaped rotatable body 26 having an integral hook 31. The body 26 is supported on a vertical shaft 27 fixed in the base 11. A helical gear 30 is rotatably mounted on shaft 27 and cooperates with a worm wheel 29 fixed on shaft 12 which when rotated will effect rotation of the body 26 about the axis of shaft 27.

Figure 3:
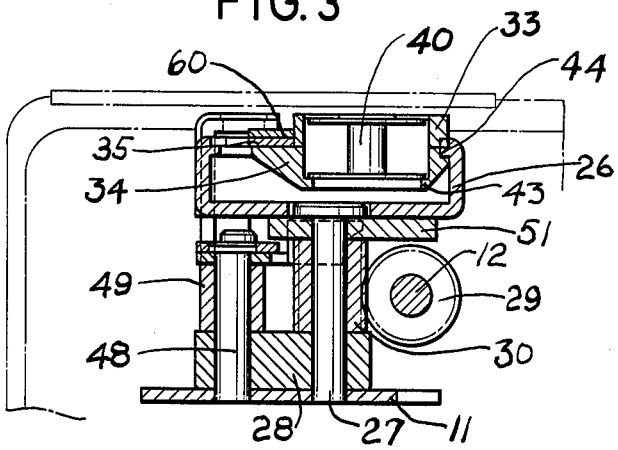
Figure 8:
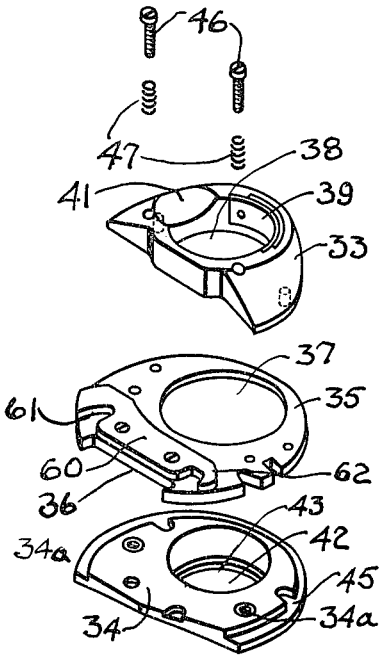
FIG. 8 is an exploded perspective view of the bobbin carrier.
Figure 7:
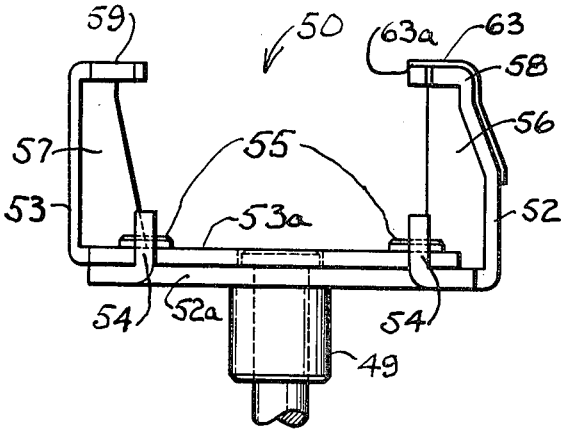
FIG. 7 is a side elevational view of a detail.

A bobbin carrier, indicated generally by the numeral 32, is received within the rotatable body 26 and is comprised of three components, an upper member 33, a lower member 34 and an intermediate member 35. The upper member 33 is formed of molded plastic material, shaped substantially as illustrated in FIG. 8, and is provided with a circular bore 38 to receive a bobbin 40. A portion of the wall of the bore 38 is recessed to accommodate a leaf spring 39 which is adjustable to control the tension of the bobbin thread. The upper surface of member 33 is smooth and without any sharp edges so as to facilitate movement of the upper thread over the surface of the member. A recess 41 is provided in the surface of the member 33 so as to facilitate engagement of a flange of the bobbin 40 by the machine operator for the purpose of removing the bobbin from the carrier. The intermediate member 35 comprises a metal plate having a circular opening 37 arranged to register with the bore 38 but is slightly larger in diameter so as to receive the lower end of the upper member 33, as illustrated in FIG. 3. The member 35 is provided with an elongated recess 36 in its periphery. The lower member 34 is formed of molded plastic material, shaped substantially as illustrated in FIG. 8, and includes a circular bore 42 provided with an annular inner shoulder 43. The marginal peripheral area 45 of the arcuate portion of member 34 is reduced in thickness to provide an arcuate stepped portion. The members 33, 34 and 35, are assembled in superposed relation, as illustrated in FIGS.

3 and 8, and are secured together, as with screws 46, which pass through registering apertures in the members 33 and 35, the screws being received in threaded openings 34*a* in member 34. Springs 47 circumposed about the screws 46 serve to bias the members 33 and 36 away from member 34 when assembled. In assembled relation the member 35 rides on an annular flange 44 provided on the inner wall of the body 26, with the flange 44 entering into the space between members 34 and 35 and overlapping the peripheral area 45. Thus, the bobbin carrier 32 is securely retained within the cavity of the rotatable body 26 and is rotatable relative thereto.

A vertical shaft 48 is secured in a mounting base 28 in parallel relation to the shaft 27, the mounting base 28 being secured to the base 11. An escapement yoke 50 provided with a depending collar 49 is rockably supported on shaft 48. The escapement yoke 50 is formed of two parts 52 and 53 secured together, as with screws 55. Part 52 includes a horizontal portion 52*a* fixed to collar 49 and having a pair of spaced upstanding lugs 54 constituting a fork arranged to engage an eccentric cam 51 secured to the underside of the rotatable body 26. Said part also includes an upstanding arm 56 terminating in an inwardly bent horizontal beak 58.

Part 53 includes a horizontal portion 53*a* preferably provided with elongated slots, not shown, through which the screws 55 extend to afford adjustment in securement of the two parts 52 and 53 in assembled relation.

Figure 6:
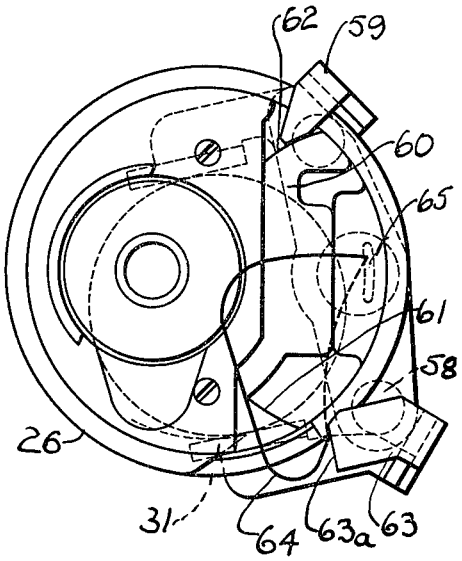
FIG. 6 is a fragmentary top plan view, similar to FIG. 4, and on an enlarged scale, of the device in a different functioning position.

Part 53 includes an upstanding arm 57 terminating in an inwardly bent horizontal beak 59. As seen in FIG. 6, both beaks 58 and 59 overhang the marginal peripheral areas of the bobbin carrier 32. It will be understood that where no adjustment is desired the escapement yoke 50 may be formed as a unitary member.

Secured to the member 35 is a plate member 60, shaped substantially as illustrated in FIG. 8. Plate member 60 is formed of metal and is superposed on the member 35 in registration with recess 36. Said plate member includes two abutment faces 61 and 62, the curvature of face 61 being substantially concave and the curvature of abutment face 62 being convex. The beaks 58 and 59 are similarly shaped, each having an edge face, complementary to a respective abutment face so that each edge face will slide smoothly against a cooperating abutment face in the operation of the device. Mounted on escapement part 52 is a guide plate 63 shown more clearly in FIGS. 4, 6 and 7. Guide plate 63 includes a horizontal arm which overlies and overhangs beak 58. The leading edge 63*a* of the guide plate 63 has a breadth which is substantially greater than that of the forward edge of the beak 58. When the upper thread loop 64, loosened by reason of being drawn off hook 31 is being drawn upwardly through the needle hole 65 by the thread take-up, not shown, the possibility exists that the thread may work its way behind beak 58 and thus, result in thread breakage or fouling of the operation of the sewing machine. With the use of the guide plate 63, the thread 64 is held by the leading edge 63*a*, as shown in FIG. 6, and prevented from moving behind beak 58.

In the operation of the mechanism above described, the body 26 makes two complete revolutions for each stitch or entry of the needle into the needle hole 65. The hook 31 functions to catch a loop formed by the upper thread 64 and to pass it around the bobbin 40. If the bobbin carrier 32 were not restrained, in the manner hereinabove described, by friction it would be carried along with the rotatable body 26.

Figure 4:
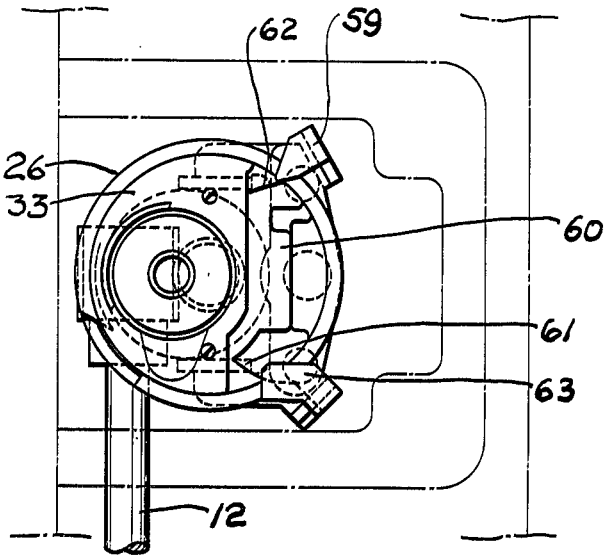
FIG. 4 is a top plan view of the device illustrated in FIG. 2.
Figure 5:
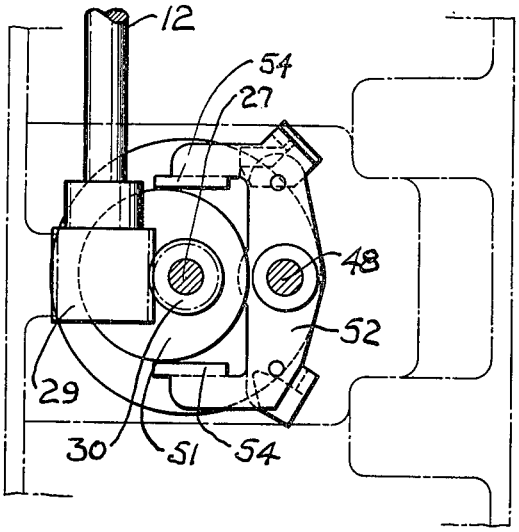
FIG. 5 is a bottom plan view of the device in a particular functioning position.

Cam 51 fixed to the rotatable body 26, which rotates in a counter clockwise direction, as viewed in FIG. 6, effects oscillating movement of the escapement yoke 50 about shaft 48. In such movement, when hook 31 reaches the position shown in FIG. 6, beak 58 has moved to its maximum distance away from the abutment face 61 affording maximum clearance between the abutment 61 and beak 58 for the passage of thread 64 to allow the thread to begin to move around the bobbin carrier 32. Correspondingly, as seen in FIG. 6, at this point beak 59 is in its position of maximum engagement with abutment face 62 and serving to prevent rotation of bobbin carrier 32. As hook 31 continues to move counter clockwise, escapement 50 is caused to rock clockwise so that when hook 31 is disposed adjacent abutment face 62, beak 59 has moved away from abutment face 62 a maximum distance to provide space for the passage of thread 64 therethrough. Correspondingly, beak 58 is moved into a position of maximum engagement with abutment face 61. In the course of rotation of body 26 at least one of the beaks 58, 59 is always in engagement with a respective aubtment face 61, 62 thereby preventing rotation of bobbin carrier 32 which remains in fixed position. FIG. 4 illustrates a position in which both beaks 58 and 59 are momentarily in engagement, at the same time, with abutment faces 61 and 62.

It will be understood that the adjustment feature permits relative adjustment of parts 52 and 53 to effect proper positioning of the beaks 58 and 59 in relation to their respective abutment faces 61 and 62 so as to provide desired contact and also spacing for passage of the thread 64.

Various changes coming within the spirit of my invention may suggest themselves to those skilled in the art; hence I do not wish to be limited to the specific embodiments shown and described or uses mentioned, but intend the same to be merely exemplary, the scope of my invention being limited only by the appended claims.

I claim:

1. In a sewing machine, a loop taker mechanism comprising a vertical shaft, a rotatable casing having a hook formed on an edge of the casing wall and rotatable on said shaft, a cam secured to the underside of said casing, a bobbin carrier rotatably supported in said casing, said carrier having on its upper surface a pair of spaced abutment faces, an adjustable escapement yoke mounted for oscillation about an axis parallel to said shaft, said yoke comprising first and second parts, the first part having a horizontal member including a forked portion embracing said cam and having an upstanding arm terminating in a first horizontal beak, said second part having a horizontal member superimposed on said first mentioned horizontal member and having an upstanding arm terminating in a second horizontal beak, each of said beaks cooperating with a respective abutment face in such a manner that one of said beaks always is in engagement with one of said abutment faces so as to prevent rotation of said bobbin carrier, the oscillation of said escapement yoke effecting alternate spacing between each pair of beaks and abutment faces for the passage of an upper thread loop, a guide plate overhanging one of said beaks, the leading edge of said guide plate serving to retain the thread loop released from said hook so as to prevent the thread loop from moving behind said beak, and means for adjustably securing said first and second parts together to effect adjustment in the engagement of respective pairs of said beaks and abutment faces.

2. The invention as defined in claim 1 in which the leading edge of the guide plate has a breadth greater than that of the respective beak.

* * * * *